US011612539B2

(12) United States Patent
Kodama

(10) Patent No.: US 11,612,539 B2
(45) Date of Patent: Mar. 28, 2023

(54) CHAIR-TYPE MASSAGER

(71) Applicant: Fuji Medical Instruments Mfg. Co., Ltd., Osaka (JP)

(72) Inventor: Shogo Kodama, Osaka (JP)

(73) Assignee: Fuji Medical Instruments Mfg. Co., Ltd., Osaka (JP)

( * ) Notice: Subject to any disclaimer, the term of this patent is extended or adjusted under 35 U.S.C. 154(b) by 227 days.

(21) Appl. No.: 16/785,006

(22) Filed: Feb. 7, 2020

(65) Prior Publication Data

US 2020/0397645 A1 Dec. 24, 2020

(30) Foreign Application Priority Data

Jun. 24, 2019 (JP) ..... JP2019-116659

(51) Int. Cl.
*A61H 9/00* (2006.01)

(52) U.S. Cl.
CPC ... *A61H 9/0078* (2013.01); *A61H 2201/0149* (2013.01); *A61H 2205/108* (2013.01)

(58) Field of Classification Search
CPC ..... A61H 9/0078; A61H 2201/0149; A61H 2205/108; A61H 7/007; A61H 2205/06; A61H 2201/0192; A61H 2203/0425; A61H 9/00; A61H 15/00; A61H 2003/006
See application file for complete search history.

(56) References Cited

U.S. PATENT DOCUMENTS 10,441,497 B2 * 10/2019 Yoshida ..... A61H 23/0263
10,729,611 B2 * 8/2020 Ode ..... A61H 15/0078
10,966,899 B2 * 4/2021 Ode ..... A61H 9/0078
10,966,901 B2 * 4/2021 Masuda ..... A61H 9/0078
2006/0142676 A1 * 6/2006 Fujii ..... A61H 7/007 601/99
2009/0227912 A1 * 9/2009 Enami ..... A61H 9/0078 601/49

(Continued)

FOREIGN PATENT DOCUMENTS

JP 2005224598 A 8/2005
JP 2012011098 A 1/2012

(Continued)

OTHER PUBLICATIONS

Office Action/JPO, Notice of Reasons for Refusal dated Feb. 7, 2023, in Japanses application No. 2019-116659, 7 pages with its translation.

*Primary Examiner* — Samchuan C Yao
*Assistant Examiner* — Tyler A Raubenstraw
(74) *Attorney, Agent, or Firm* — Masuvalley & Partners; Peter R. Martinez

(57) ABSTRACT

An armrest portion of a chair-type massager includes a side wall disposed generally upright at either of the left and right sides of a seat portion. An air bag configured to press the thighs of a treated person is provided on a seat side face which is the side face of the armrest portion facing the seat portion along the left-right axis. The seat side face includes a side face of the side wall facing the seat portion and an installation face. The installation face, at least when the air bag is inflated, inclines the further to the seat portion side along the left-right axis the higher up. At least part of the air bag is provided on the installation face.

11 Claims, 8 Drawing Sheets

(56) References Cited

U.S. PATENT DOCUMENTS

| | | | | |
|---|---|---|---|---|
| 2010/0137758 | A1* | 6/2010 | Nagamitsu | A61H 7/004 601/97 |
| 2010/0145245 | A1* | 6/2010 | Chen | A61H 9/0078 601/149 |
| 2010/0198120 | A1* | 8/2010 | Tago | A61H 1/0292 601/149 |
| 2010/0249613 | A1* | 9/2010 | Hashimoto | A61B 5/0245 600/485 |
| 2014/0343467 | A1* | 11/2014 | Fukuyama | A61H 9/0078 601/98 |
| 2015/0351997 | A1* | 12/2015 | Le | A61H 9/0078 601/150 |
| 2017/0056280 | A1* | 3/2017 | Ode | A61H 9/0078 |
| 2017/0348179 | A1* | 12/2017 | Inada | G06Q 20/14 |
| 2019/0328608 | A1* | 10/2019 | Le | G16H 20/30 |
| 2020/0022867 | A1* | 1/2020 | Inada | A61H 1/00 |
| 2020/0121549 | A1* | 4/2020 | Inada | A61H 1/006 |

FOREIGN PATENT DOCUMENTS

| | | | |
|---|---|---|---|
| JP | 2013085571 | A | 5/2013 |
| JP | 2013-215402 | A | 10/2013 |

* cited by examiner

CHAIR-TYPE MASSAGER

CROSS-REFERENCE TO RELATED APPLICATIONS

This application is based upon and claims the benefit of priority from the corresponding Japanese Patent Application No. 2019-116659 filed on Jun. 24, 2019, the contents of which are hereby incorporated by reference.

BACKGROUND OF THE INVENTION

Field of the Invention

The present invention relates to a chair-type massager.

Description of Related Art

Conventionally, there are known chair-type massagers which press the thighs of a treated person along the left-right axis. For example, a massaging chair disclosed in JP-A-2013-215402 incorporates bellows-type air bags in left and right armrest portions. The air bags at the left and right armrest portions inflate by being supplied with air and hold both thighs of the treated person to press them.

However, it is difficult to administer sufficient stimulus to an upper part of the thigh of the treated person. Thus, treatment for the thigh is not always satisfactory to the treated person.

SUMMARY OF THE INVENTION

To cope with that, the present invention is aimed at providing a chair-type massager which can treat an upper part of the thigh of a treated person sufficiently.

According to one aspect of the present invention, in order to achieve the above object, a chair-type massager includes a seat portion supporting the thigh of the treated person, an armrest portion supporting the forearm of the treated person, and an air bag configured to press the thigh of the treated person. The armrest portion includes a side wall disposed generally upright at either of the left and right sides of the seat portion. The air bag is provided on a seat side face which is the side face of the armrest portion facing the seat portion along the left-right axis. The seat side face includes a side face of the side wall facing the seat portion and an installation face. The installation face, at least when the air bag is inflated, inclines inward toward a seat portion side as the installation face goes higher up. At least part of the air bag is provided on the installation face.

This and other characteristics of the present disclosure, and the specific benefits obtained according to the present disclosure, will become apparent from the description of embodiments which follows.

DETAILED DESCRIPTION OF PREFERRED EMBODIMENTS

Exemplary embodiments of the present invention will be described in detail below with reference to the accompanying drawings.

Figure 1:
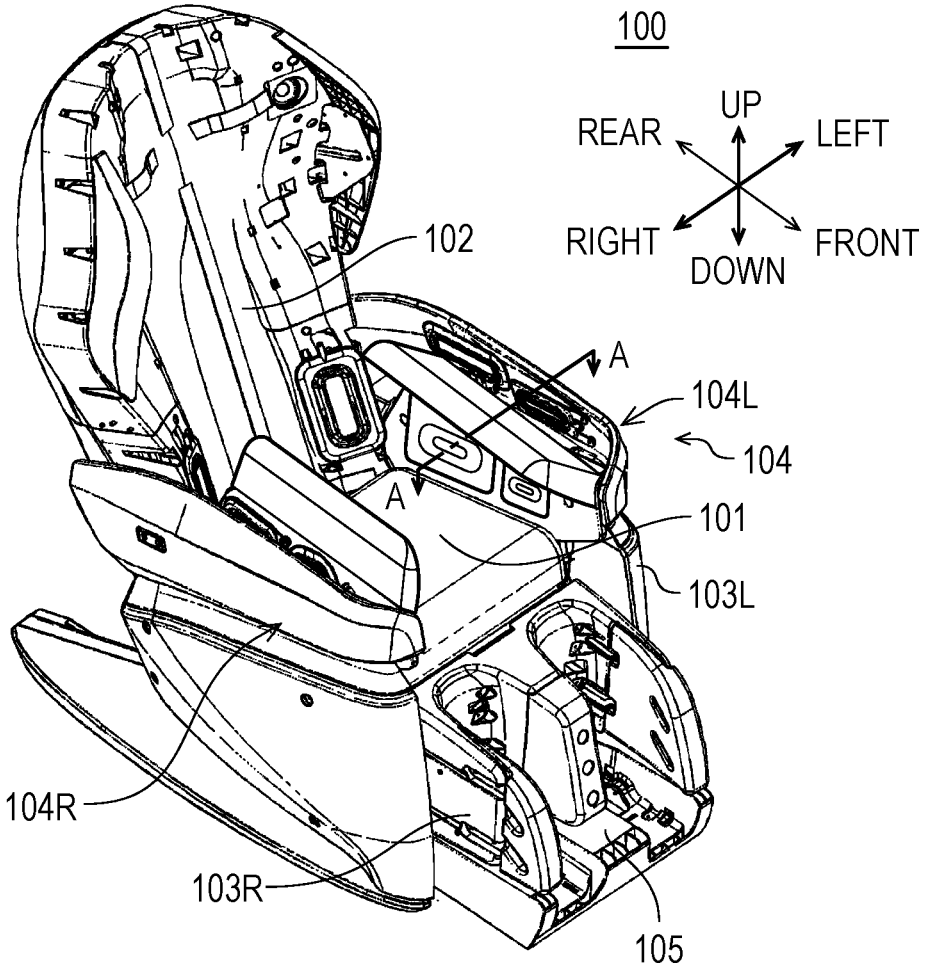
FIG. 1 is a perspective view of a chair-type massager according to an embodiment.

FIG. 1 is a perspective view of a chair-type massager 100. In the following description, the chair-type massager 100 is referred to as the "massager 100". In FIG. 1, and also in FIGS. 3A to 8B referred to later, only parts constituting the framework of the massager 100 are illustrated.

In the following description, different sides are referred to as follows. The term "front" is used to indicate the front side as seen from a treated person seated on the massager 100 with a backrest portion 102, which will be described later, uncollapsed. The term "rear" is used to indicate the rear side as seen from a treated person seated on the massager 100 with the backrest portion 102 uncollapsed. The term "upper" is used to indicate the upper side (head side) as seen from a treated person seated on the massager 100 with the backrest portion 102 uncollapsed. The term "lower" is used to indicate the lower side (leg side) as seen from a treated person seated on the massager 100 with the backrest portion 102 uncollapsed. The term "right" is used to indicate the right side as seen from a treated person seated on the massager 100 with the backrest portion 102 uncollapsed. The term "left" is used to indicate the left side as seen from a treated person seated on the massager 100 with the backrest portion 102 uncollapsed.

Massager

The massager 100 includes a seat portion 101; a backrest portion 102; a pair of, namely left and right, base portions 103L and 103R; a pair of, namely left and right, armrest portions 104L and 104R, and an ottoman 105. The backrest portion 102, the armrest portions 104L and 104R, and the ottoman 105 are attached to a body portion, which includes the seat portion 101 and the base portions 103L and 103R.

The seat portion 101 supports the buttocks and the thighs of the treated person.

The backrest portion 102 supports the shoulders, the lower back, and the back of the treated person. The backrest portion 102 is attached to the rear end of the seat portion 101 so as to be pivotable about a reclining rotation axis (omitted from illustration) extending along the left-right axis. The backrest portion 102 is provided with a massage unit (omitted from illustration) including treating elements, and with an air bag (no reference sign assigned) for lower back treatment. The massage unit is guided by guide rails (omitted from illustration) provided in the backrest portion 102 to ascend and descend along the lengthwise (longer-side) axis of the backrest portion 102. Here, the guide rails may be extended to a rear part of the seat portion 101 to allow the massage unit to ascend and descend along the lengthwise axis of the seat portion 101 and the backrest portion 102. The massage unit includes the treating elements (omitted from illustration), a kneading driving mechanism (omitted from illustration) which makes the treating elements perform kneading operation, and a tapping driving mechanism (omitted from illustration) which makes the treating elements perform tapping operation. The air bag for lower back treatment inflates by being supplied with air, and can thereby press both the left and right sides of the lower back of the treated person seated on the massager 100.

The base portion 103L is disposed generally upright on the left side of the seat portion 101, and supports the armrest portion 104L. The base portion 103R is disposed generally upright on the right side of the seat portion 101, and supports the armrest portion 104R.

The armrest portion 104L supports the left forearm and the left hand of the treated person, and the armrest portion 104R supports the right forearm and the right hand of the treated person. The armrest portions 104L and 104R are shaped symmetrically left to right. In the following description, the armrest portions 104L and 104R are occasionally referred to collectively as the "armrest portion(s) 104". On the side faces (hereinafter referred to as the "seat side faces 10") of the armrest portion 104 facing the seat portion 101 along the left-right axis, as will described later, a treatment mechanism for the thigh of the treated person is provided. The structure of the armrest portion 104 and the treatment mechanism for the thigh will be described later.

The ottoman 105 accommodates the lower legs and the feet of the treated person. The ottoman 105 is pivotable about a rotation axis (omitted from illustration) that extends along the left-right axis under a front-end part of the seat portion 101. The ottoman 105 is provided with an air bag (omitted from illustration). As the air bag inflates and deflates, massage is administered to the lower legs and the feet of the treated person.

The massager 100, as will be described later, further includes an air bag 2 for treating the thighs of the treated person. The air bag 2 will be described later.

Control System of the Massager

Figure 2:
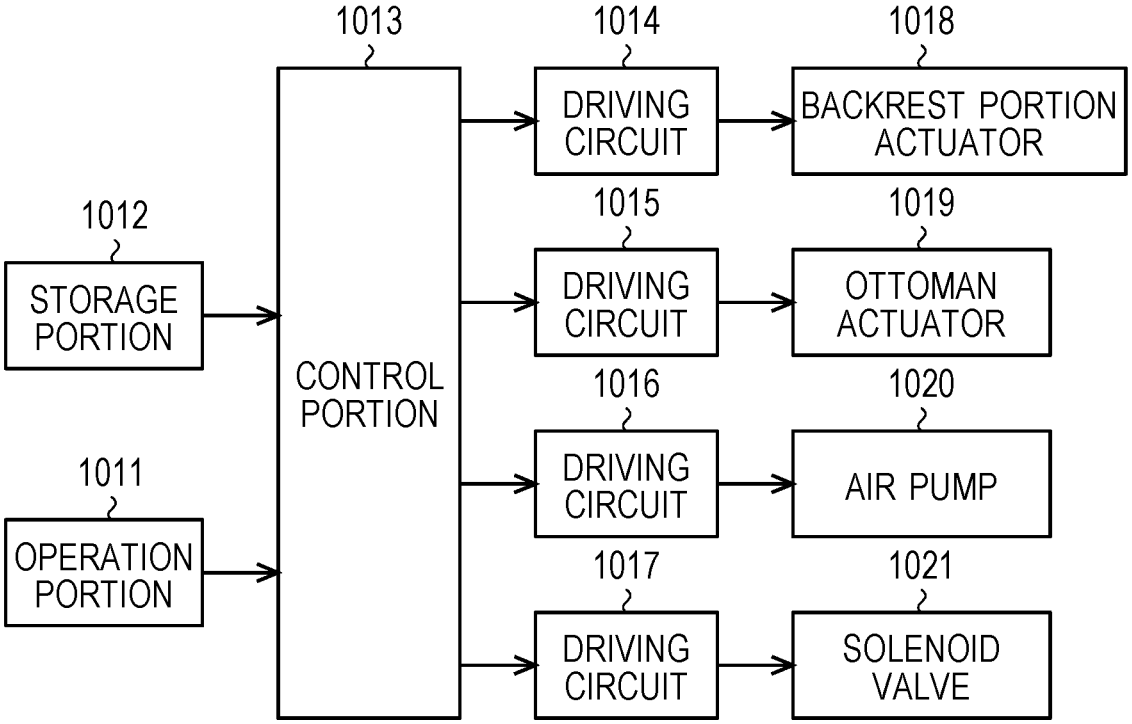
FIG. 2 is a block diagram showing the control system that controls the operation of the chair-type massager according to the embodiment.

Next, an example of the configuration of the control system of the massager 100 will be described. FIG. 2 is a block diagram showing the control system that controls the operation of the massager 100.

The massager 100 includes an operation portion 1011, a storage portion 1012, a control portion 1013, driving circuits 1014 to 1017, a backrest portion actuator 1018 that makes the backrest portion 102 pivot, an ottoman actuator 1019 that makes the ottoman 105 pivot, an air pump 1020, and a group of solenoid valves 1021.

The operation portion 1011 accepts operation and input by a treated person or the like, and feeds the control portion 1013 with signals based on such operation and input.

The storage portion 1012 is a non-transitory storage medium that holds the information stored in it even on failure of the supply of electric power. The storage portion 1012 stores, for example, programs and data that the control portion 1013 needs to control the operation of the massager 100.

The control portion 1013 controls the operation of the massager 100. For example, the control portion 1013 controls the backrest portion actuator 1018 via the driving circuit 1014; the control portion 1013 controls the ottoman actuator 1019 via the driving circuit 1015; the control portion 1013 controls the air pump 1020 via the driving circuit 1016; the control portion 1013 controls the group of solenoid valves 1021 via the driving circuit 1017.

The group of solenoid valves 1021 includes a plurality of solenoid valves. Some of the solenoid valves are provided between the air pump 1020 and the group of air bags provided in the massager 100 to switch the intervening passages between a communicating state and a shut-off state. The group of air bags includes, for example, an air bag for treating the lower back, an air bag 1042 for treating the arms, which will be described later, and the air bag 2 for treating the thighs. Some other of the solenoid valves are provided between the group of air bags and the outside to switch the intervening passages between a communicating state and a shut-off state. For example, when some of the solenoid valves so operate that the air pump 1020 communicates with an air bag, air is supplied from the air pump 1020 via the solenoid valve to the air bag so that the air bag inflates. For another example, when some other of the solenoid valves so operate that an air bag communicates with the outside, the air inside the air bag is discharged via the solenoid valve to the outside. As the air inside the air bag is discharged, the air bag deflates. For another example, when those solenoid valves so operate that the air bag communicates neither with the air pump 1020 nor with the outside, the air inside the air bag is retained.

Structure of the Armrest Portion and the Treatment Mechanism for the Thighs

Figure 3A:
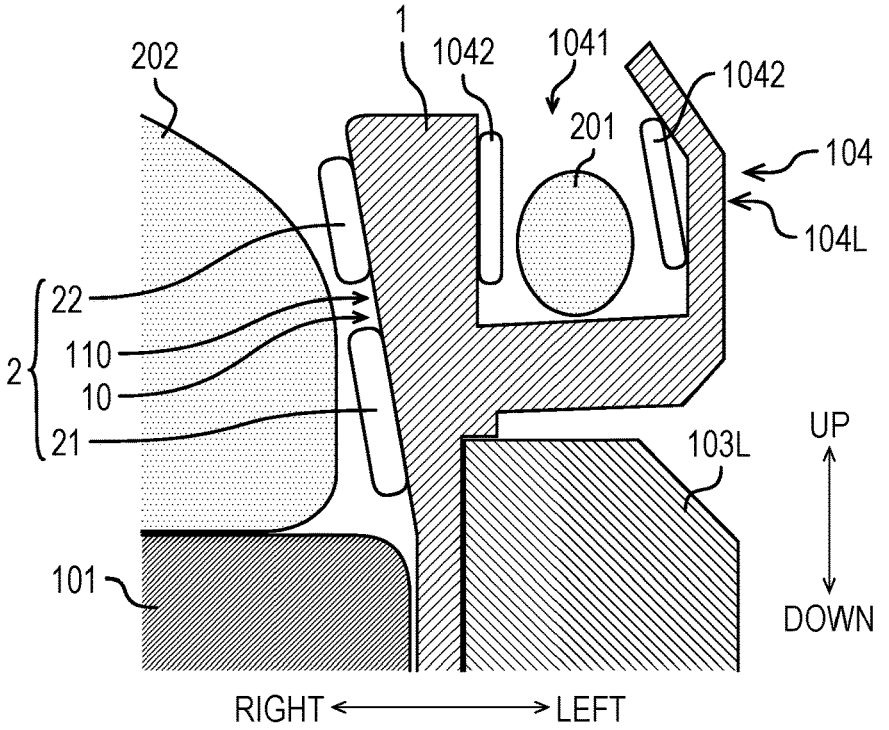
FIG. 3A is a diagram showing an example of the structure of the armrest portion and the treatment mechanism for the thigh according to the embodiment.
Figure 3B:
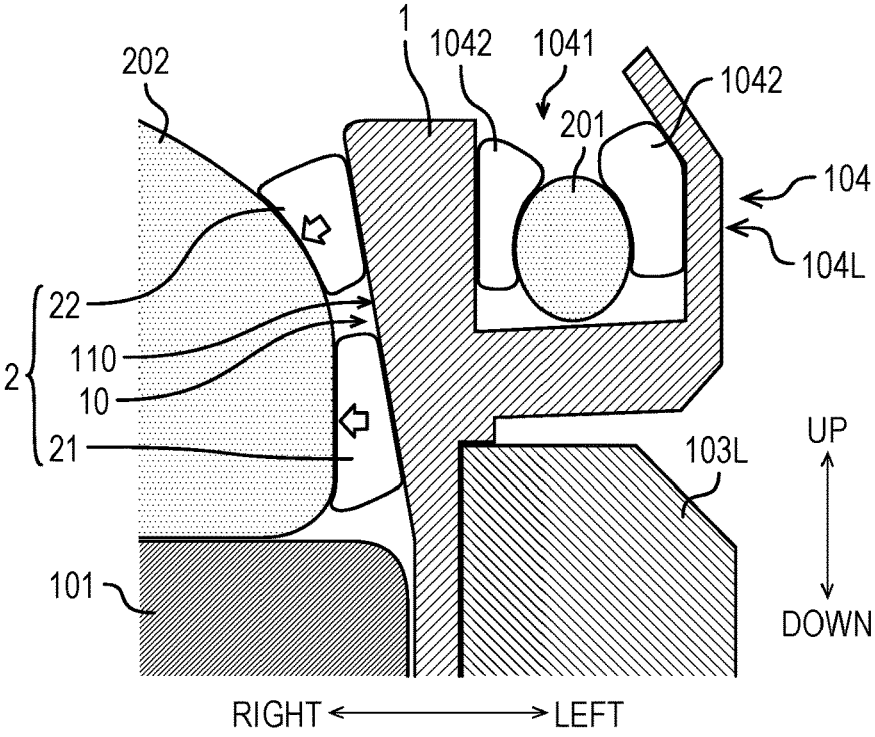
FIG. 3B is a diagram showing the operation of the treatment mechanism for the thigh according to the embodiment during treatment.

Next, with reference to FIGS. 3A and 3B, the structure of the armrest portion 104 and a treatment mechanism for the thigh 202 of the treated person will be described. FIG. 3A is a diagram showing an example of the structure of the armrest portion 104 and the treatment mechanism for the thigh 202 according to the embodiment. FIG. 3B is a diagram showing the operation of the treatment mechanism for the thigh 202 according to the embodiment during treatment. FIGS. 3A and 3B show a cross-sectional structure around the armrest portion 104 as seen from in front along dash-dot line A-A in FIG. 1.

The armrest portion 104 has a recess 1041 that is depressed downward. The recess 1041 in this embodiment accommodates the forearm 201 and the entire hand of the treated person. This, however, is not meant as any limitation. The recess 1041 can accommodate and support only part of the forearm 201 and the hand, or only the forearm 201, of the treated person. The recess 1041 is provided with an air bag 1042. As air is supplied and discharged, the air bag 1042 inflates and deflates, and thereby massage is administered to the forearm 201 of the treated person. Unlike in this embodiment, the recess 1041 can be provided with any treating means other than an air bag 1042, or with no treating means at all.

The armrest portion 104 includes a side wall 1. The side wall 1 is disposed generally upright at either of the left and right sides of the seat portion 101. The side face of the side wall 1 facing the seat portion 101 along the left-right axis faces the thigh 202 of the treated person seated on the seat portion 101. The seat side face 10 of the armrest portion 104 facing the seat portion 101 along the left-right axis includes the side face of the side wall 1 facing the seat portion 101 along the left-right axis.

As mentioned previously, the seat side face 10 is provided with a treatment mechanism for the thigh 202 of the treated person. The treatment mechanism for the thigh 202 includes an air bag 2 for treating the thigh. The air bag 2 can press the thigh 202 of the treated person and is provided on the seat side face 10. The air bag 2 inflates as air is supplied from the air pump 1020 and deflates as air is discharged to the outside. In this embodiment, the air bag 2 is fastened to the seat side face 10 and is bonded to the seat side face 10 with, for example, adhesive. This, however, is not meant as any limitation. The air bag 2 may be provided on the seat side face 10 in a form supported by an unillustrated supporting member.

Here, the seat side face 10 further includes an installation face 110 on which at least part of the air bag 2 is provided. In FIGS. 3A and 3B, the whole area of the seat side face 10 above the seat portion 101 is the installation face 110, which inclines inward toward a seat portion 101 side as the installation face goes higher up. Thus, on the installation face 110, the entire air bag 2 is provided.

What is specifically shown in FIGS. 3A and 3B, however, is not meant as any limitation. The installation face 110 can be part (for example, an upper part) of the area of the seat side face 10 above the seat portion 101. Here, another part (for example, a lower part) of the area of the seat side face 10 above the seat portion 101 may be a face parallel to the up-down axis. Furthermore, on the installation face 110, only part of the air bag 2 may be provided.

In the structure described above, at least when the air bag 2 is inflated, the installation face 110 inclines inward toward a seat portion 101 side as the installation face goes higher up. Furthermore, at least part of the air bag 2 (for example, in FIG. 3B, a second air bag 22, which will be described later) is provided on the installation face 110. Thus, at least part of the air bag 2, when air is supplied to it, inflates in the direction away from the installation face 110. Accordingly, the inflating air bag 2 can press toward the seat portion 101 an upper part of the thigh 202 of the treated person seated on the seat portion 101. It is also possible to increase the pressure to the upper part of the thigh 202 by inflating the air bag 2 further. By deflating the air bag 2, it is possible to reduce or remove the pressure to the upper part of the thigh 202. Thus, it is possible to treat with sufficient stimulus the upper part of the thigh 202 of the treated person.

The air bag 2 includes, as shown in FIGS. 3A and 3B, a first air bag 21 and a second air bag 22 provided above the first air bag 21.

The first and second air bags 21 and 22, when air is supplied to them, inflate in the direction away from the seat side face 10 and, when air is discharged from them, deflate in the direction toward the seat side face 10. As the first and second air bags 21 and 22 inflate and deflate, the thigh 202 of the treated person can be treated with stimulus.

The first and second air bags 21 and 22 may each be composed of a single air bag or a plurality of air bags. When at least one of the first and second air bags 21 and 22 is composed of a plurality of air bags, it is possible, for example, to array those air bags along the front-back axis and deflate part of them in a different manner than the other, thereby to administer complex treatment along the lengthwise axis of the thigh 202.

In FIGS. 3A and 3B, the first and second air bags 21 and 22 are both provided on the installation face 110. In this way, as the first and second air bags 21 and 22 inflate and deflate, the thigh 202 of the treated person can be pressed toward the seat portion 101 over a wider range along the up-down axis. This, however, is not meant as any limitation. The first air bag 21 may not be provided on the installation face 110. By providing at least the second air bag 22 on the installation face 110, a treating means dedicated to an upper part of the thigh 202 of the treated person can be provided. Thus, the upper part of the thigh 202 can be treated more reliably.

The first and second air bags 21 and 22 are fixed to the installation face 110 by being bonded to it with, for example, adhesive. This, however, is not meant as any limitation. The first and second air bags 21 and 22 may be fixed by any fixing means other than by bonding, or may be supported by an unillustrated supporting member.

MODIFIED EXAMPLES

Next, a first to a fifth modified example of the treatment mechanism for the thigh 202 of the treated person will be described. In the respective modified examples described below, features unseen in the embodiments described above and other modified examples will be described. Such elements as find their counterparts in the embodiment described above or in another modified example are assigned the same reference signs and their description will sometimes be omitted.

First Modified Example

Figure 4A:
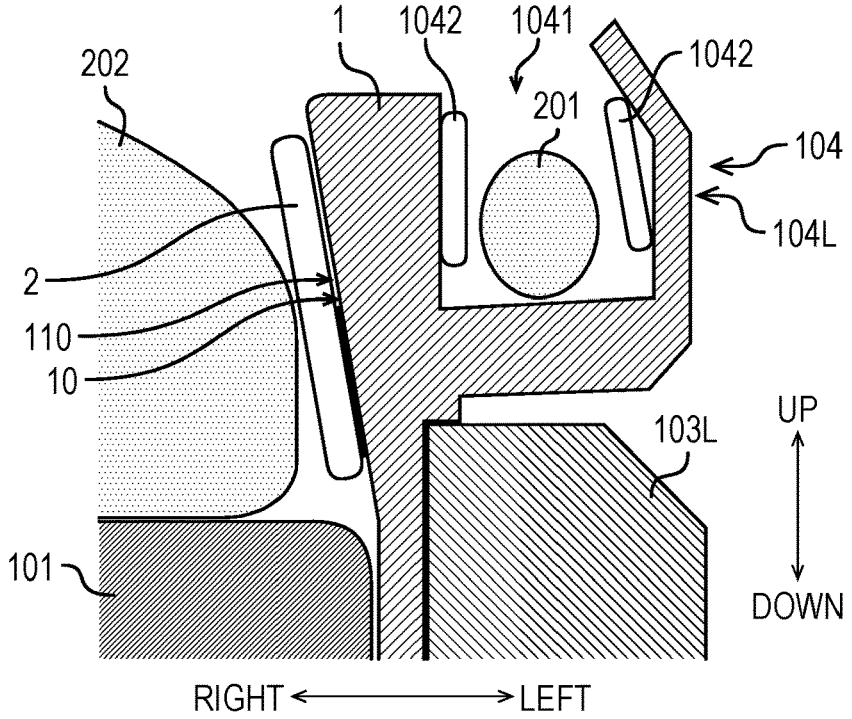
FIG. 4A is a diagram showing an example of the structure of the armrest portion and the treatment mechanism for the thigh according to a first modified example.
Figure 4B:
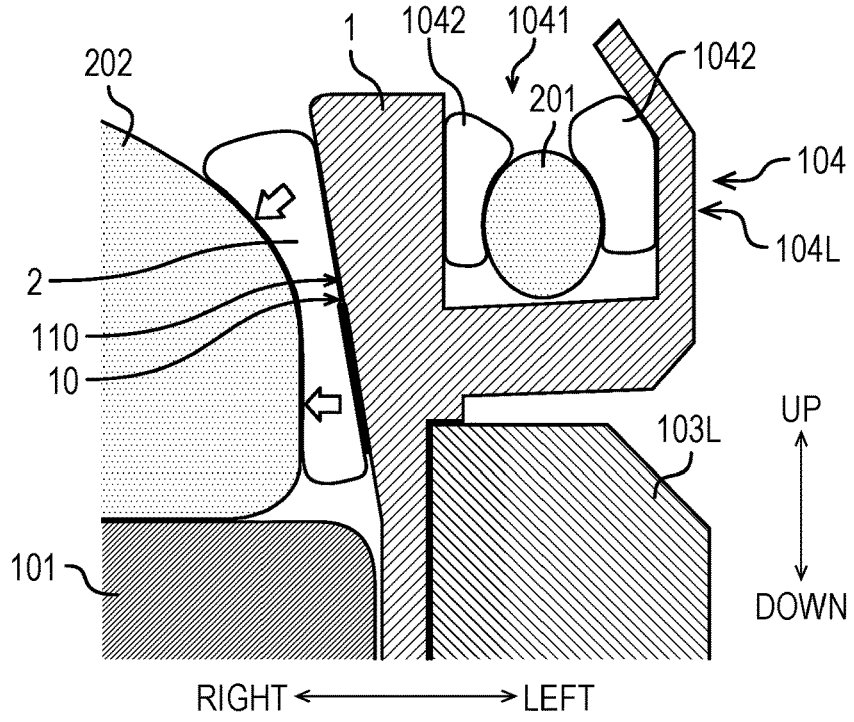
FIG. 4B is a diagram showing the operation of the treatment mechanism for the thigh according to the first modified example during treatment.

FIG. 4A is a diagram showing an example of the structure of the armrest portion 104 and the treatment mechanism for the thigh 202 according to the first modified example. FIG. 4B is a diagram showing the operation of the treatment mechanism for the thigh 202 according to the first modified example during treatment. The cross-sectional structure in FIGS. 4A and 4B corresponds to that around the armrest portion 104 as seen from in front along dash-dot line A-A in FIG. 1.

In the first modified example, along the up-down axis, one air bag 2 is arranged on the seat side face 10. One or a plurality of air bags 2 may be provided along the front-back axis. Only a lower part of the air bag 2 is fixed to the seat side face 10. That is, an upper part of the air bag 2 is not fixed to the seat side face 10. Thus, the upper part of the air bag 2, which is not fixed to the seat side face 10, can inflate more than the lower part of the air bag 2, which is fixed to the seat side face 10.

The lower part of the air bag 2 is fixed by being bonded with, for example, adhesive. This, however, is not meant as any limitation. The lower part of the air bag 2 may be fixed by any fixing means other than by bonding, or may be supported by an unillustrated supporting member.

In FIGS. 4A and 4B, the whole air bag 2 is arranged on the installation face 110 at the seat side face 10. This, however, is not meant as any limitation. Part of the air bag 2 (for example, an upper part) may be arranged on the installation face 110. When, for example, the seat side face 10 includes the installation face 110 and a face parallel to the up-down axis, another part (for example, a lower part) of the air bag 2 may be arranged on the latter face.

By providing at least part of the air bag 2 on the installation face 110, when the air bag 2 inflates, at least the upper part of the air bag 2 inflates in the direction away from the installation face 110. Accordingly, it is possible to press harder the thigh 202 (especially the upper part of it) of the treated person. Thus, it is possible to treat with stronger stimulus the upper part of the thigh 202 of the treated person.

Second Modified Example

Figure 5A:
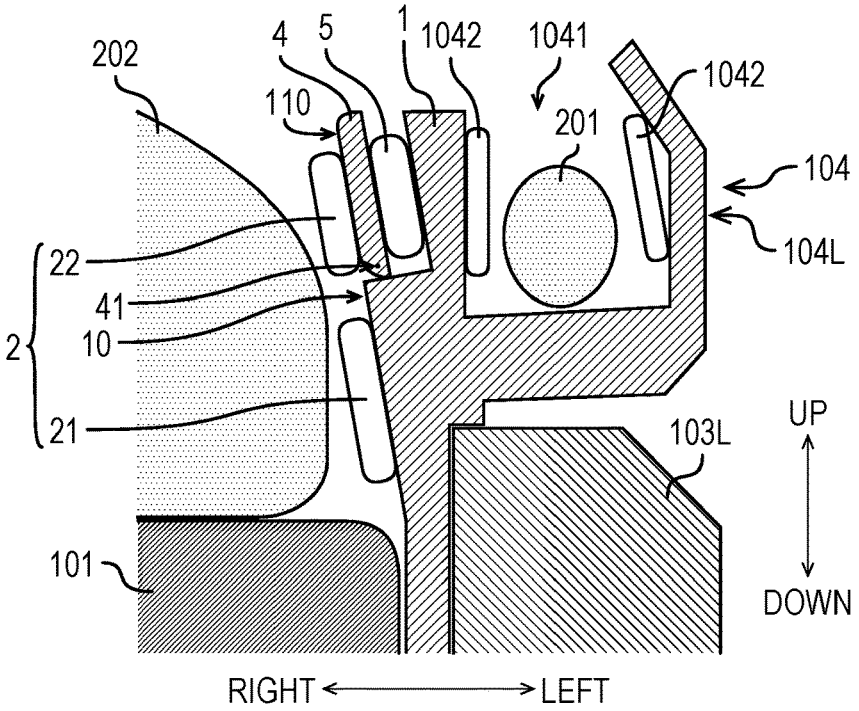
FIG. 5A is a diagram showing an example of the structure of the armrest portion and the treatment mechanism for the thigh according to a second modified example.
Figure 5B:
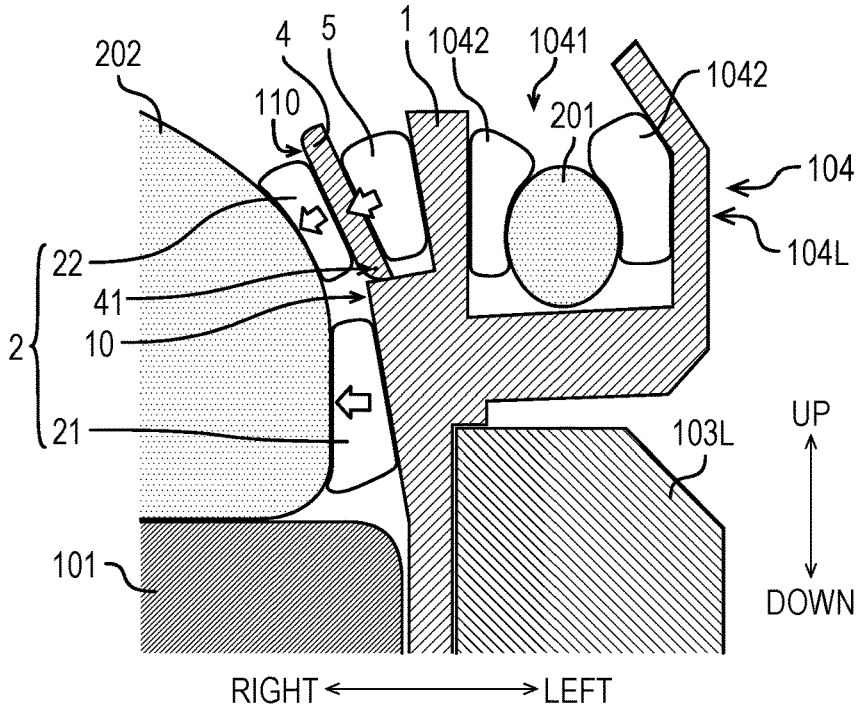
FIG. 5B is a diagram showing the operation of the treatment mechanism for the thigh according to the second modified example during treatment.

FIG. 5A is a diagram showing an example of the structure of the armrest portion 104 and the treatment mechanism for the thigh 202 according to the second modified example. FIG. 5B is a diagram showing the operation of the treatment mechanism for the thigh 202 according to the second modified example during treatment. The cross-sectional structure in FIGS. 5A and 5B corresponds to that around the armrest portion 104 as seen from in front along dash-dot line A-A in FIG. 1.

In the second modified example, the armrest portion 104 further includes, in addition to the side wall 1 and the air bag 2, a movable wall 4 and a driving air bag 5. The movable wall 4 is provided in an upper end part of the side wall 1, on the seat portion 101 side. The driving air bag 5 is provided between the side wall 1 and the movable wall 4. Along the left-right axis, the side of the driving air bag 5 facing the side wall 1 is fixed to the side wall 1, and the side of the driving air bag 5 facing the movable wall 4 is fixed to the movable wall 4. The fixing here is achieved, for example, by bonding using adhesive. This, however, is not meant as any limitation. Any fixing means other than by bonding may instead be used.

A lower part of the movable wall 4 is fixed to the side wall 1. As the driving air bag 5 inflates and deflates, the movable wall 4 is pivotable about the lower part of the movable wall 4. More specifically, in a lower part of the movable wall 4, a rotary shaft 41 extending along the front-back axis is provided. The movable wall 4 is rotatable about the rotary shaft 41. For example, when the driving air bag 5 inflates as air is supplied to it, the movable wall 4 pivots about the rotary shaft 41 and moves closer to the seat portion 101. When the driving air bag 5 deflates as air is discharged from it, the movable wall 4 pivots about the rotary shaft 41 and moves away from the seat portion 101.

In the second modified example, the installation face 110 is the side face of the movable wall 4 facing the seat portion 101. In FIGS. 5A and 5B, the installation face 110 inclines inward toward a seat portion 101 side as the installation face goes higher up. This, however, is not meant as any limitation. The installation face 110 may not be inclined as mentioned above except when the air bag 2 is inflated; it may be, for example, parallel to the up-down axis. In other words, the installation face 110 may, at least when the air bag 2 is inflated, incline the further to the seat portion 101 side along the left-right axis the higher up. In FIGS. 5A and 5B, also an area of the seat side face 10 above the seat portion 101 but below the movable wall 4 inclines the further to the seat portion 101 side along the left-right axis the higher up. This, however, is not meant as any limitation. This area may not be inclined as mentioned above; it may be, for example, parallel to the up-down axis.

The air bag 2 includes the first and second air bags 21 and 22. The first air bag 21 is provided in the area of the seat side face 10 above the seat portion 101 but below the movable wall 4, and is fixed to the area with, for example, adhesive. The second air bag 22 is provided on the side face (that is, the installation face 110) of the movable wall 4 facing the seat portion 101, and is fixed to the installation face 110 with, for example, adhesive. This, however, is not meant as any limitation. The first and second air bags 21 and 22 may be fixed by any fixing means other than by bonding, or may be supported by an unillustrated supporting member.

According to the second modified example, when the second air bag 22 inflates, the driving air bag 5 inflates and makes the movable wall 4 pivot toward the seat portion 101, and this allows an upper part of the thigh 202 of the treated person to be pressed harder. Thus, it is possible to treat with still stronger stimulus the upper part of the thigh 202 of the treated person.

Third Modified Example

Figure 6A:
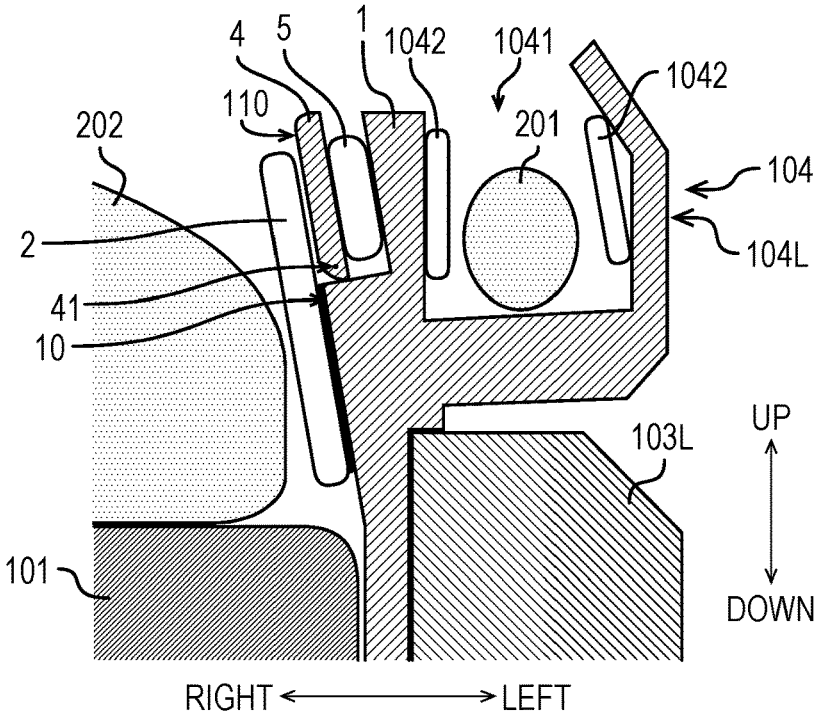
FIG. 6A is a diagram showing an example of the structure of the armrest portion and the treatment mechanism for the thigh according to a third modified example.
Figure 6B:
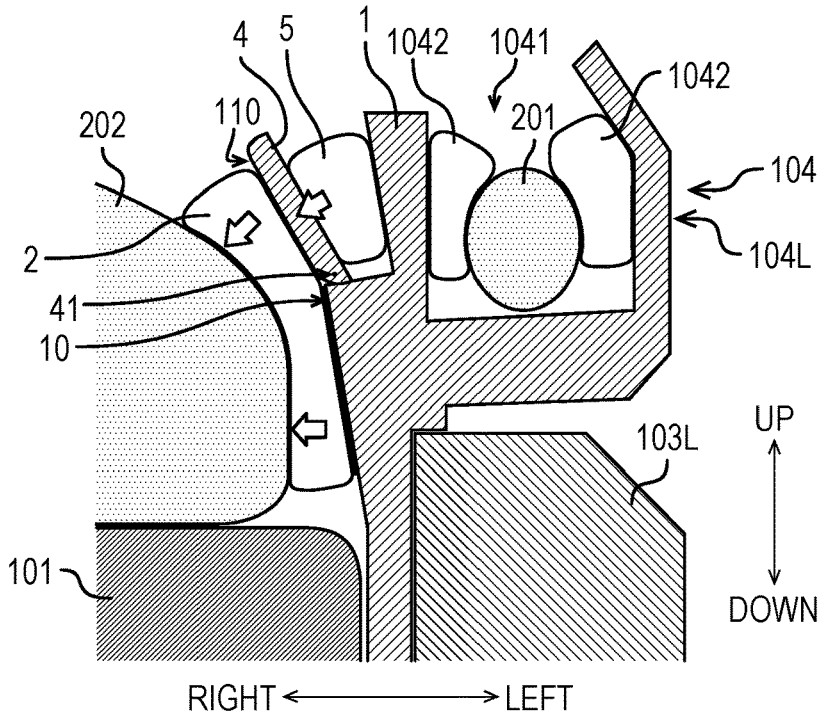
FIG. 6B is a diagram showing the operation of the treatment mechanism for the thigh according to the third modified example during treatment.

FIG. 6A is a diagram showing an example of the structure of the armrest portion 104 and the treatment mechanism for the thigh 202 according to the third modified example. FIG. 6B is a diagram showing the operation of the treatment mechanism for the thigh 202 according to the third modified example during treatment. The cross-sectional structure in FIGS. 6A and 6B corresponds to that around the armrest portion 104 as seen from in front along dash-dot line A-A in FIG. 1.

In the third modified example, the armrest portion 104 includes, as in the second modified example, a side wall 1, an air bag 2, a movable wall 4, and a driving air bag 5. On the other hand, unlike in the second modified example, along the up-down axis, one air bag 2 is arranged on the seat side face 10. One or a plurality of air bags 2 may be provided along the front-back axis. Preferably, as shown in FIGS. 6A and 6B, only a lower part of the air bag 2 is fixed to the seat side face 10, and an upper part of the air bag 2 is not fixed to the seat side face 10. Thus, the upper part of the air bag 2, which is not fixed to the seat side face 10, can inflate more than the lower part of the air bag 2, which is fixed to the seat side face 10.

The upper part of the air bag 2 is provided on the side face (that is, the installation face 110) of the movable wall 4 facing the seat portion 101. The lower part of the air bag 2 is provided in the area of the seat side face 10 above the seat portion 101 but below the movable wall 4. The lower part of the air bag 2 is bonded to the area with, for example, adhesive. This, however, is not meant as any limitation. The lower part of the air bag 2 may be fixed by any fixing means other than by bonding, or may be supported by an unillustrated supporting member.

As in the second modified example, the installation face 110 may, at least when the air bag 2 is inflated, incline the further to the seat portion 101 side along the left-right axis the higher up. Furthermore, also the area of the seat side face 10 above the seat portion 101 but below the movable wall 4 may not be inclined as shown in FIGS. 6A and 6B; it may be, for example, parallel to the up-down axis.

In this way, when the air bag 2 inflates, an upper part of the air bag 2 inflates prominently in the direction away from the installation face 110. Pivoting the movable wall 4 about the rotary shaft 41 by inflating the driving air bag 5 allows an upper part of the thigh 202 of the treated person to be pressed harder. Accordingly, as the upper part of the air bag 2 inflates and deflates and the movable wall 4 pivots, it is possible to treat with stronger stimulus the upper part of the thigh 202 of the treated person.

Fourth Modified Example

Figure 7A:
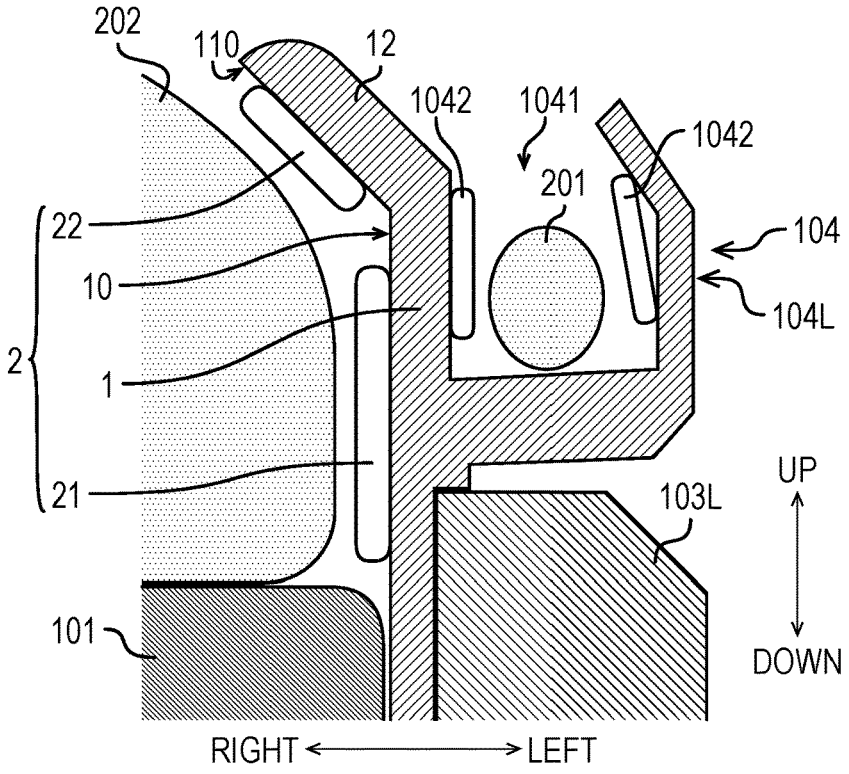
FIG. 7A is a diagram showing an example of the structure of the armrest portion and the treatment mechanism for the thigh according to a fourth modified example.
Figure 7B:
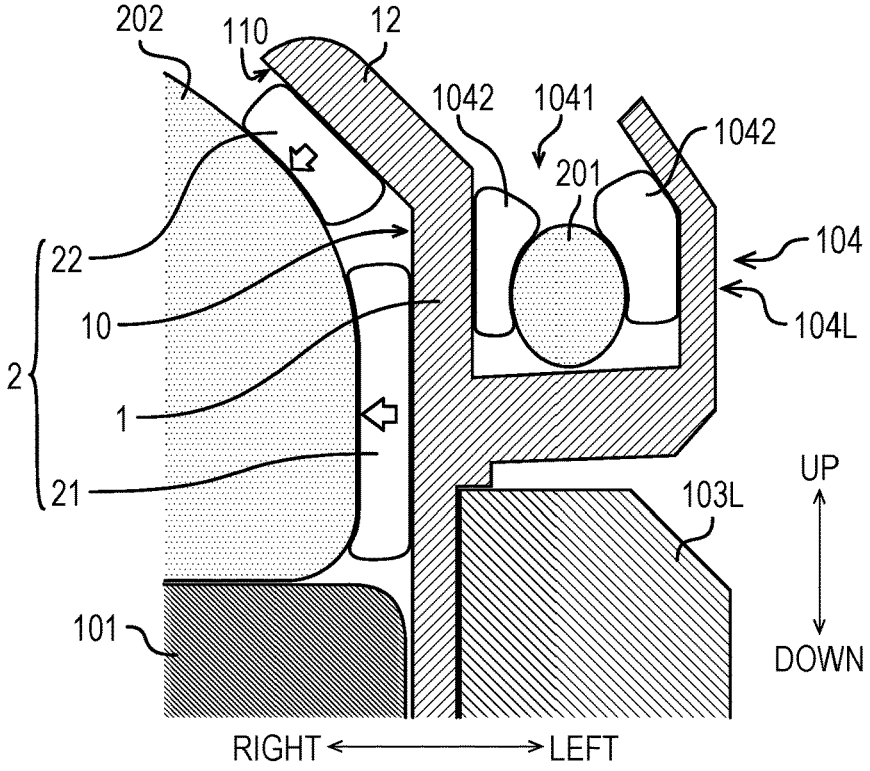
FIG. 7B is a diagram showing the operation of the treatment mechanism for the thigh according to the fourth modified example during treatment.

FIG. 7A is a diagram showing an example of the structure of the armrest portion 104 and the treatment mechanism for the thigh 202 according to the fourth modified example. FIG. 7B is a diagram showing the operation of the treatment mechanism for the thigh 202 according to the fourth modified example during treatment. The cross-sectional structure in FIGS. 7A and 7B corresponds to that around the armrest portion 104 as seen from in front along dash-dot line A-A in FIG. 1.

In the fourth modified example, the armrest portion 104 includes a side wall 1 and an air bag 2. The side wall 1 includes a protruding wall portion 12. The protruding wall portion 12 is provided at an upper end part of the side wall 1 so as to protrude toward the seat portion 101 along the left-right axis and simultaneously upward, and extends along the front-back axis. The installation face 110 is provided on the protruding wall portion 12, or more specifically, on the side face of the protruding wall portion 12 facing the seat portion 101.

The air bag 2 includes, as shown in FIGS. 7A and 7B, first and second air bags 21 and 22. The first air bag 21 is provided in the area of the seat side face 10 above the seat portion 101 but below the protruding wall portion 12, and is fixed to the area with, for example, adhesive. The second air bag 22 is provided on the side face (that is, the installation face 110) of the protruding wall portion 12 facing the seat portion 101, and is fixed to the installation face 110 with, for example, adhesive. This, however, is not meant as any limitation. The first and second air bags 21 and 22 may be fixed by any fixing means other than by bonding, or may be supported by an unillustrated supporting member.

According to the fourth modified example, the second air bag 22 is provided on the installation face 110 on the protruding wall portion 12. Accordingly, as the second air bag 22 inflates, an upper part of the thigh 202 of the treated person can be pressed hard. Thus, it is possible to treat with sufficient stimulus the upper part of the thigh 202 of the treated person.

In the fourth modified example, what is specifically shown in FIGS. 7A and 7B is not meant as any limitation. Instead, one air bag 2 may be arranged on the seat side face 10 along the up-down axis. One or a plurality of air bags 2 may be provided along the front-back axis. Furthermore, an upper part of the air bag 2 may be provided on the side face (that is, the installation face 110) of the protruding wall portion 12 facing the seat portion 101, and a lower part of the air bag 2 may be provided on the area above the seat portion 101 but below the protruding wall portion 12. In this case, preferably, only the lower part of the air bag 2 is fixed to the seat side face 10, and the upper part of the air bag 2 is not fixed to the seat side face 10. In this way, as the upper part of the air bag 2 inflates prominently, the upper part of the thigh 202 of the treated person can be pressed hard. Thus, as in the structure shown in FIGS. 7A and 7B, it is possible to treat with sufficient stimulus the upper part of the thigh 202 of the treated person.

Fifth Modified Example

Figure 8A:
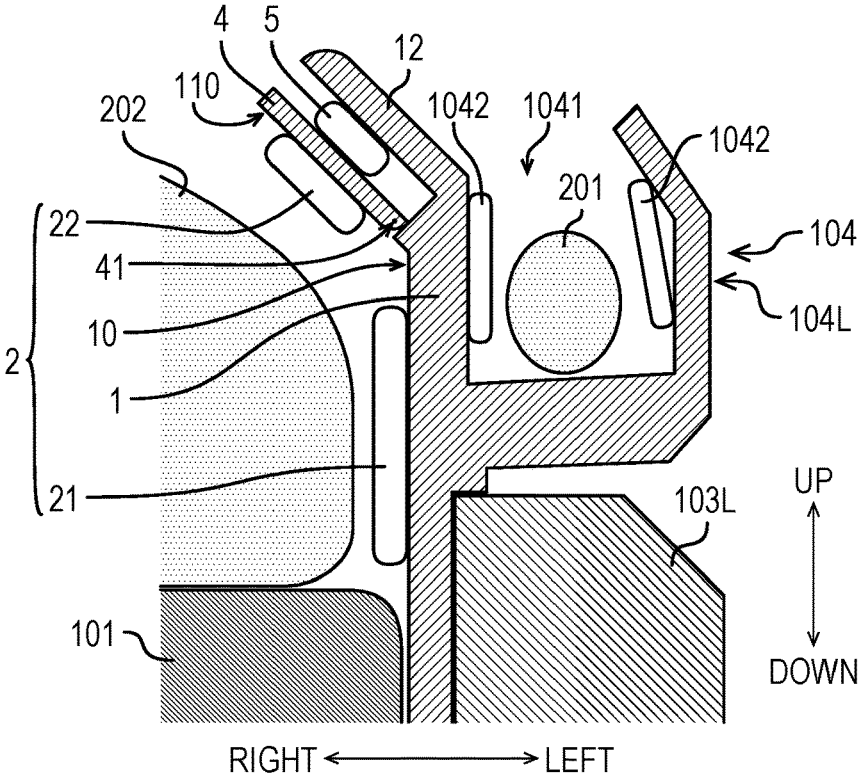
FIG. 8A is a diagram showing an example of the structure of the armrest portion and the treatment mechanism for the thigh according to a fifth modified example.
Figure 8B:
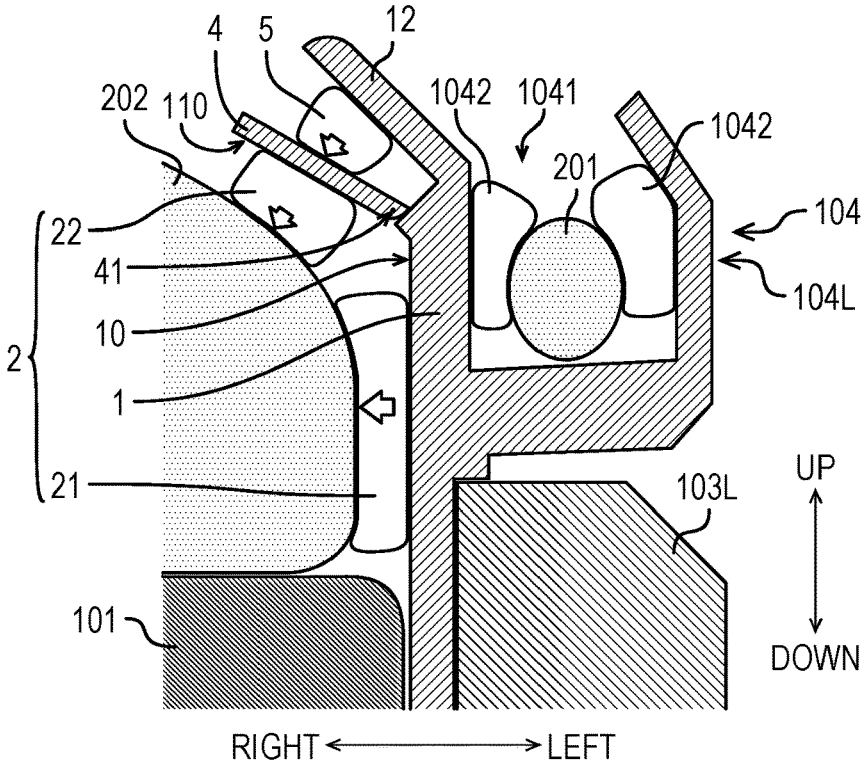
FIG. 8B is a diagram showing the operation of the treatment mechanism for the thigh according to the fifth modified example during treatment.

FIG. 8A is a diagram showing an example of the structure of the armrest portion 104 and the treatment mechanism for the thigh 202 according to the fifth modified example. FIG. 8B is a diagram showing the operation of the treatment mechanism for the thigh 202 according to the fifth modified example during treatment. The cross-sectional structure in FIGS. 8A and 8B corresponds to that around the armrest portion 104 as seen from in front along dash-dot line A-A in FIG. 1.

In the fifth modified example, the armrest portion 104 includes a side wall 1, an air bag 2, a movable wall 4, and a driving air bag 5. The side wall 1 includes a protruding wall portion 12. The protruding wall portion 12 is provided at an upper end part of the side wall 1 so as to protrude toward the seat portion 101 along the left-right axis and simultaneously upward, and extends along the front-back axis.

The movable wall 4 is provided on the protruding wall portion 12. More specifically, a lower part of the movable wall 4 is fitted to the protruding wall portion 12, on the seat portion 101 side. The driving air bag 5 is provided between the movable wall 4 and the protruding wall portion 12. As the driving air bag 5 inflates and deflates, the movable wall 4 is pivotable about a rotary shaft 41 at the lower part of the movable wall 4.

In the fifth modified example, the installation face 110 is provided on the movable wall 4 and is, more specifically, the side face of the movable wall 4 facing the seat portion 101.

The air bag 2 includes, in FIGS. 8A and 8B, first and second air bags 21 and 22. The first air bag 21 is provided in the area of the seat side face 10 above the seat portion 101 but below the protruding wall portion 12, and is fixed to the area with, for example, adhesive. The second air bag 22 is provided on the side face (that is, the installation face 110) of the movable wall 4 facing the seat portion 101, and is fixed to the installation face 110 with, for example, adhesive. This, however, is not meant as any limitation. The first and second air bags 21 and 22 may be fixed by any fixing means other than by bonding, or may be supported by an unillustrated supporting member.

According to the fifth modified example, the second air bag 22 is provided on the side face of the protruding wall portion 12 facing the seat portion 101 so as to protrude toward the seat portion 101 side along the left-right axis and simultaneously upward. Accordingly, as the second air bag 22 inflates, an upper part of the thigh 202 of the treated person can be pressed. Here, as the driving air bag 5 inflates, it makes the movable wall 4 pivot toward the seat portion 101; it is thus possible to press the upper part of the thigh 202 of the treated person harder. Accordingly, with the inflation and deflation of the second air bag 22 and the pivoting of the movable wall 4, it is possible to treat with stronger stimulus the upper part of the thigh 202 of the treated person.

In the fifth modified example, what is specifically shown in FIGS. 8A and 8B is not meant as any limitation. Instead, one air bag 2 may be arranged on the seat side face 10 along the up-down axis. One or a plurality of air bags 2 may be provided along the front-back axis. Furthermore, an upper part of the air bag 2 may be provided on the side face (that is, the installation face 110) of the protruding wall portion 12 facing the seat portion 101, and a lower part of the air bag 2 may be provided on the area of the seat side face 10 above the seat portion 101 but below the movable wall 4. In this case, preferably, only the lower part of the air bag 2 is fixed to the seat side face 10, and the upper part of the air bag 2 is not fixed to the seat side face 10. Also in this way, as in the structure shown in FIGS. 8A and 8B, as the second air bag 22 inflates and deflates and the movable wall 4 pivots, it is possible to treat with stronger stimulus the upper part of the thigh 202 of the treated person.

OVERVIEW

The chair-type massager 100 described above includes a seat portion 101 supporting the thigh of a treated person, an armrest portion 104 supporting the forearm of the treated person, and an air bag 2 configured to press the thigh of the treated person.

The armrest portion 104 includes a side wall 1 disposed generally upright at either of the left and right sides of the seat portion 101. The air bag 2 is provided on the seat side face 10 which is the side face of the armrest portion 104 facing the seat portion 101 along the left-right axis. The seat side face 10 includes a side face of the side wall 1 facing the seat portion 101 and an installation face 110 which, at least when the air bag 2 is inflated, inclines inward toward a seat portion 101 side as the installation face goes higher up. At least part of the air bag 2 is provided on the installation face 110. (a first configuration)

In the chair-type massager 100 according to the first configuration described above, the air bag 2 may include a first air bag 21, and a second air bag 22 provided above the first air bag 21. At least the second air bag 22 may be provided on the installation face 110. (a second configuration)

Alternatively, in the chair-type massager 100 according to the first configuration described above, only a lower part of the air bag 2 may be fixed to the seat side face 10. (a third configuration)

In the chair-type massager 100 according to the first to third configurations described above, the armrest portion 104 may further include a movable wall 4 provided at an upper end part of the side wall 1 and a driving air bag 5 provided at an upper end part of the side wall 1 between the movable wall 4 and the side wall 1. A lower part of the movable wall 4 may be fixed to the side wall 1. As the driving air bag 5 inflates, the movable wall 4 may be pivotable about the lower part of the movable wall 4 toward the seat portion 101. The installation face 110 may be a side face of the movable wall 4 facing the seat portion 101. (a fourth configuration)

Alternatively, in the chair-type massager 100 according to the first to third configurations, the side wall 1 may include a protruding wall portion 12 provided at an upper end part of the side wall 1 so as to protrude toward the seat portion 101 along the left-right axis and simultaneously upward. The installation face 110 may be a side face of the protruding wall portion 12 facing the seat portion 101. (a fifth configuration)

In the chair-type massager 100 according to the fourth configuration described above, the side wall 1 may include a protruding wall portion 12 provided at an upper end part of the side wall 1 so as to protrude toward the seat portion 101 along the left-right axis and simultaneously upward. The installation face 110 may be the side face of the movable wall 4 facing the seat portion 101, and the lower part of the movable wall 4 may be fitted to the protruding wall portion 12. (a sixth configuration)

With the chair-type massager 100 of the any of the first to the sixth configurations described above, it is possible to treat an upper part of the thigh of the treated person sufficiently.

As would be clear to those skilled in the art, the embodiments by way of which the present invention has been described above are merely illustrative and allow for various modifications in terms of the combination of constituent elements and processes, which all fall within the scope of the present invention.

What is claimed is:

1. A chair-type massager, comprising:

a seat portion is adapted to support a thigh of a treated person;

an armrest portion is adapted to support a forearm of the treated person; and an air bag configured to press the thigh of the treated person, wherein the armrest portion further includes a recess that opens upward and that is adapted to accommodate the forearm of the treated person, and a side wall disposed generally upright at either of the left and right sides of the seat portion to form a wall surface of the recess facing the seat portion, a side face of the side wall facing the seat portion includes an installation face that inclines inward toward the seat portion side to face the seat portion as the installation face goes higher up, at least part of the air bag is provided on the installation face to be adapted to press the thigh from obliquely above, the air bag includes a first air bag, and a second air bag provided above the first air bag with respect to an up-down axis, and at least the second air bag is provided on the installation face.

2. The chair-type massager according to claim 1, wherein only a lower part of the air bag is fixed to the side face of the side wall facing the seat portion.

3. The chair-type massager according to claim 1, wherein the armrest portion further includes:

a movable wall provided at an upper end part of the side wall, and a driving air bag provided at an upper end part of the side wall between the movable wall and the side wall, and a lower part of the movable wall is fixed to the side wall, as the driving air bag inflates and deflates, the movable wall is pivotable about a rotary shaft that extends in a front-rear direction arranged in the lower part of the movable wall toward the seat portion, and the installation face is a side face of the movable wall facing the seat portion.

4. The chair-type massager according to claim 1, wherein the side wall includes a protruding wall portion provided at an upper end part of the side wall so as to protrude toward the seat portion along the left-right axis and simultaneously upward, and part of the air bag is provided on a side face of the protruding wall portion facing the seat portion.

5. The chair-type massager according to claim 3, wherein the side wall includes a protruding wall portion provided at an upper end part of the side wall so as to protrude toward the seat portion along the left-right axis and simultaneously upward, the installation face is the side face of the movable wall facing the seat portion, and the lower part of the movable wall is fitted to the protruding wall portion.

6. The chair-type massager according to claim 1, wherein at least part of the air bag provided on the installation face is adapted to press the thigh of the treated person toward the seat portion.

7. The chair-type massager according to claim 1, wherein the recess is arranged in the side wall at a side opposite from the seat portion in a left-right direction.

8. The chair-type massager according to claim 1, wherein a side face of the side wall facing the seat portion extends to below a bottom face of the recess.

9. The chair-type massager according to claim 1, wherein at least part of the air bag is arranged above the bottom face of the recess.

10. The chair-type massager according to claim 1, wherein at least part of the air bag is adapted to treat the thigh at a position above the bottom face of the recess.

11. The chair-type massager according to claim 1, wherein the installation face is arranged above the bottom face of the recess.

* * * * *